US010663901B2

(12) United States Patent
Shirodai et al.

(10) Patent No.: US 10,663,901 B2
(45) Date of Patent: May 26, 2020

(54) IMAGE FORMING APPARATUS

(71) Applicant: Konica Minolta, Inc., Chiyoda-ku, Tokyo (JP)

(72) Inventors: Yasuo Shirodai, Hachioji (JP); Makoto Fujii, Hino (JP); Masahiro Onodera, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/523,801

(22) Filed: Jul. 26, 2019

(65) Prior Publication Data

US 2020/0050137 A1 Feb. 13, 2020

(30) Foreign Application Priority Data

Aug. 10, 2018 (JP) ..... 2018-150972

(51) Int. Cl.
*G03G 15/20* (2006.01)
*G03G 15/00* (2006.01)

(52) U.S. Cl.
CPC ..... *G03G 15/5008* (2013.01); *G03G 15/2053* (2013.01); *G03G 15/505* (2013.01)

(58) Field of Classification Search
CPC ..... G03G 15/5008; G03G 15/2053; G03G 15/505
See application file for complete search history.

(56) References Cited

U.S. PATENT DOCUMENTS

2010/0008683 A1* 1/2010 Yoshikawa ..... G03G 15/1695 399/45
2016/0370740 A1* 12/2016 Kobayashi ..... G03G 15/505

FOREIGN PATENT DOCUMENTS

JP 2016-014774 A 1/2016

* cited by examiner

*Primary Examiner* — David M. Gray
*Assistant Examiner* — Michael A Harrison
(74) *Attorney, Agent, or Firm* — Squire Patton Boggs (US) LLP

(57) ABSTRACT

An image forming apparatus includes: a fixer including fixing rotation body and pressing rotation body with a fixing nip therebetween, and heats and presses a fed sheet through the fixing nip to fix a toner image on the sheet to the sheet; and a hardware processor making a velocity difference between respective surface velocities of the fixing rotation body and the sheet passing through the fixing nip during a high-gloss mode operation to adjust a gloss of the toner image on the sheet. The hardware processor performs a control so that an absolute value of a velocity difference between respective surface velocities of the fixing rotation body and the pressing rotation body in press-contact when the sheet does not pass through the fixing nip is less than one between respective surface velocities of the fixing rotation body and the sheet when the sheet passes through the fixing nip during the high-gloss mode operation.

11 Claims, 9 Drawing Sheets

FIXING BELT SURFACE VELOCITY < PRESSURE ROLLER SURFACE VELOCITY

FIXING BELT SURFACE VELOCITY > PRESSURE ROLLER SURFACE VELOCITY

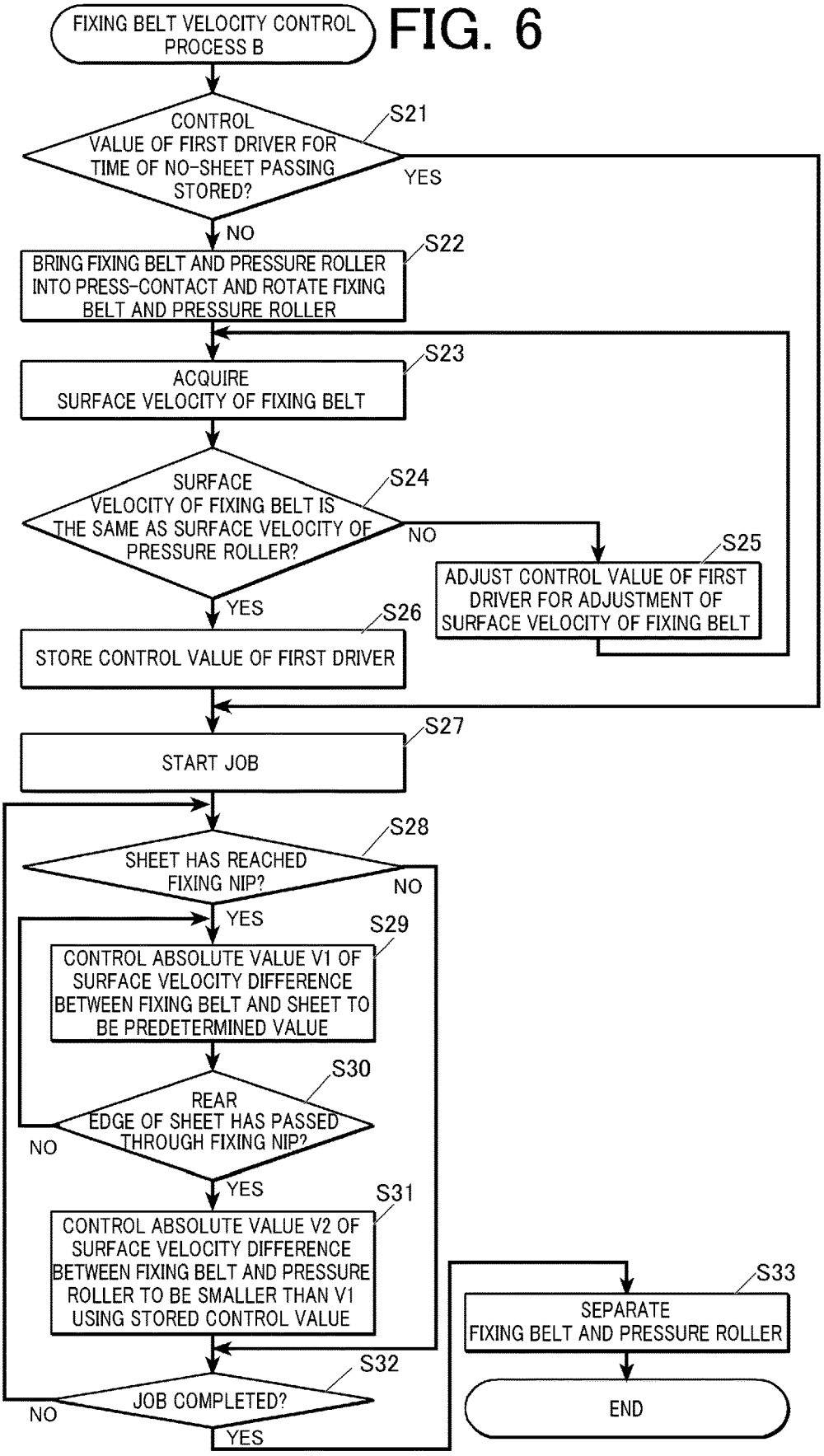
FIXING BELT VELOCITY CONTROL PROCESS B
FIG. 6
CONTROL VALUE OF FIRST DRIVER FOR TIME OF NO-SHEET PASSING STORED?
S21
YES
NO
BRING FIXING BELT AND PRESSURE ROLLER INTO PRESS-CONTACT AND ROTATE FIXING BELT AND PRESSURE ROLLER
S22
ACQUIRE SURFACE VELOCITY OF FIXING BELT
S23
SURFACE VELOCITY OF FIXING BELT IS THE SAME AS SURFACE VELOCITY OF PRESSURE ROLLER?
S24
NO
ADJUST CONTROL VALUE OF FIRST DRIVER FOR ADJUSTMENT OF SURFACE VELOCITY OF FIXING BELT
S25
YES
STORE CONTROL VALUE OF FIRST DRIVER
S26
START JOB
S27
SHEET HAS REACHED FIXING NIP?
S28
NO
YES
CONTROL ABSOLUTE VALUE V1 OF SURFACE VELOCITY DIFFERENCE BETWEEN FIXING BELT AND SHEET TO BE PREDETERMINED VALUE
S29
REAR EDGE OF SHEET HAS PASSED THROUGH FIXING NIP?
S30
NO
YES
CONTROL ABSOLUTE VALUE V2 OF SURFACE VELOCITY DIFFERENCE BETWEEN FIXING BELT AND PRESSURE ROLLER TO BE SMALLER THAN V1 USING STORED CONTROL VALUE
S31
JOB COMPLETED?
S32
NO
YES
SEPARATE FIXING BELT AND PRESSURE ROLLER
S33
END

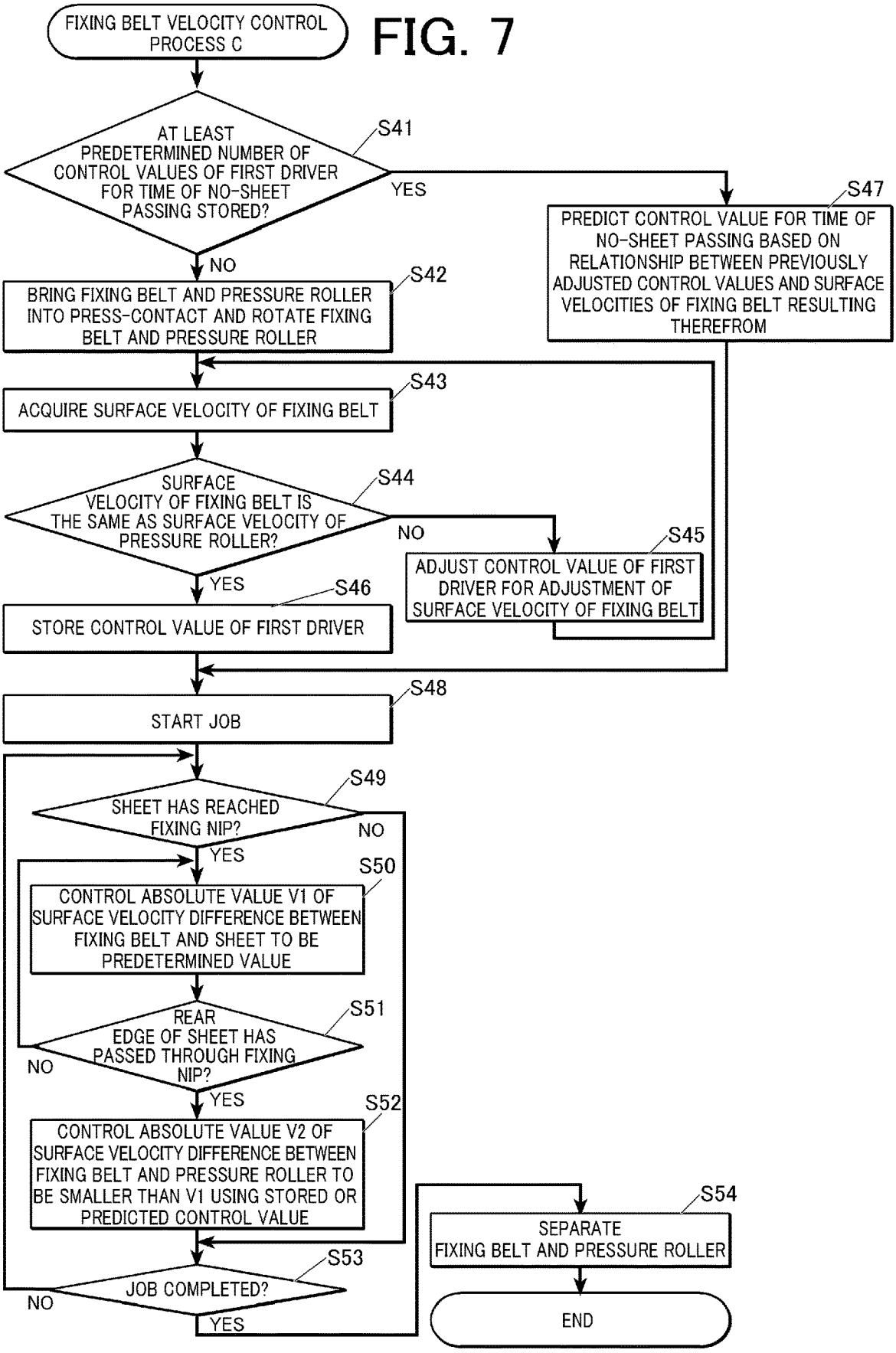
FIXING BELT VELOCITY CONTROL PROCESS C
FIG. 7
AT LEAST PREDETERMINED NUMBER OF CONTROL VALUES OF FIRST DRIVER FOR TIME OF NO-SHEET PASSING STORED?
S41
YES
NO
S47
PREDICT CONTROL VALUE FOR TIME OF NO-SHEET PASSING BASED ON RELATIONSHIP BETWEEN PREVIOUSLY ADJUSTED CONTROL VALUES AND SURFACE VELOCITIES OF FIXING BELT RESULTING THEREFROM
S42
BRING FIXING BELT AND PRESSURE ROLLER INTO PRESS-CONTACT AND ROTATE FIXING BELT AND PRESSURE ROLLER
S43
ACQUIRE SURFACE VELOCITY OF FIXING BELT
S44
SURFACE VELOCITY OF FIXING BELT IS THE SAME AS SURFACE VELOCITY OF PRESSURE ROLLER?
NO
S45
ADJUST CONTROL VALUE OF FIRST DRIVER FOR ADJUSTMENT OF SURFACE VELOCITY OF FIXING BELT
YES
S46
STORE CONTROL VALUE OF FIRST DRIVER
S48
START JOB
S49
SHEET HAS REACHED FIXING NIP?
NO
YES
S50
CONTROL ABSOLUTE VALUE V1 OF SURFACE VELOCITY DIFFERENCE BETWEEN FIXING BELT AND SHEET TO BE PREDETERMINED VALUE
S51
REAR EDGE OF SHEET HAS PASSED THROUGH FIXING NIP?
NO
YES
S52
CONTROL ABSOLUTE VALUE V2 OF SURFACE VELOCITY DIFFERENCE BETWEEN FIXING BELT AND PRESSURE ROLLER TO BE SMALLER THAN V1 USING STORED OR PREDICTED CONTROL VALUE
S53
JOB COMPLETED?
NO
YES
S54
SEPARATE FIXING BELT AND PRESSURE ROLLER
END

IMAGE FORMING APPARATUS

BACKGROUND

1. Technological Field

The present invention relates to an image forming apparatus.

2. Description of the Related Art

According to a conventional technology for a fixer (fuser) including: a fixing rotation body and a pressing rotation body that are rotated by respective individual drivers; and a nip pressure adjustment mechanism that changes a nip pressure of a fixing nip as desired, a rotation speed of the fixing rotation body and/or the pressing rotation body is variably controlled so as not to increase a difference in linear velocity between the fixing rotation body and the pressing rotation body at the fixing nip during a period from the start to the completion of the operation of the nip pressure adjustment mechanism (see, for instance, JP 2016-14774A).

Meanwhile, making a velocity difference between a surface velocity of the fixing rotation body and a surface velocity of a sheet when the sheet passes through the fixing nip is supposed to cause shear (shearing force) on an image surface of the sheet, smoothly floating the image surface with an increased glossiness. However, when shear is caused between the fixing rotation body and the sheet to increase the glossiness, an outer layer of the fixing rotation body is sometimes damaged, resulting in occurrence of image noise.

SUMMARY

An object of the present invention is to reduce occurrence of image noise in an image forming apparatus, which changes glossiness by making a velocity difference between a surface velocity of a fixing rotation body and a surface velocity of a sheet when the sheet passes through a fixing nip.

To achieve at least one of the abovementioned objects, according to an aspect of the present invention, an image forming apparatus includes:

a fixer that includes a fixing rotation body and a pressing rotation body between which a fixing nip is formed, and heats and presses a fed sheet through the fixing nip so that a toner image formed on the sheet is fixed to the sheet; and a hardware processor that makes a velocity difference between a surface velocity of the fixing rotation body and a surface velocity of the sheet passing through the fixing nip during an operation in a high-gloss mode to adjust a gloss of the toner image formed on the sheet, in which the hardware processor controls an absolute value of a velocity difference between the surface velocity of the fixing rotation body and a surface velocity of the pressing rotation body at a time when the sheet does not pass through the fixing nip with the fixing rotation body and the pressing rotation body being in press-contact with each other to be smaller than an absolute value of the velocity difference between the surface velocity of the fixing rotation body and the surface velocity of the sheet at a time when the sheet passes through the fixing nip during the operation in the high-gloss mode.

According to another aspect of the present invention, an image forming apparatus includes:

a fixer that includes a fixing rotation body and a pressing rotation body between which a fixing nip is formed, and heats and presses a fed sheet through the fixing nip so that a toner image formed on the sheet is fixed to the sheet; and a hardware processor that makes a velocity difference between a surface velocity of the fixing rotation body and a surface velocity of the sheet passing through the fixing nip during an operation in a high-gloss mode to adjust a gloss of the toner image formed on the sheet, in which the hardware processor does not drive the fixing rotation body but forces the fixing rotation body be driven by the rotating pressing rotation body, when the sheet does not pass through the fixing nip with the fixing rotation body and the pressing rotation body being in press-contact with each other.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the preset invention. Herein:

FIG. 6 is a flowchart showing a fixing belt velocity control process B being performed by the controller shown in FIG. 2;

FIG. 7 is a flowchart showing a fixing belt velocity control process C being performed by the controller shown in FIG. 2;

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Configuration of Image Forming Apparatus 1

Figure 1:
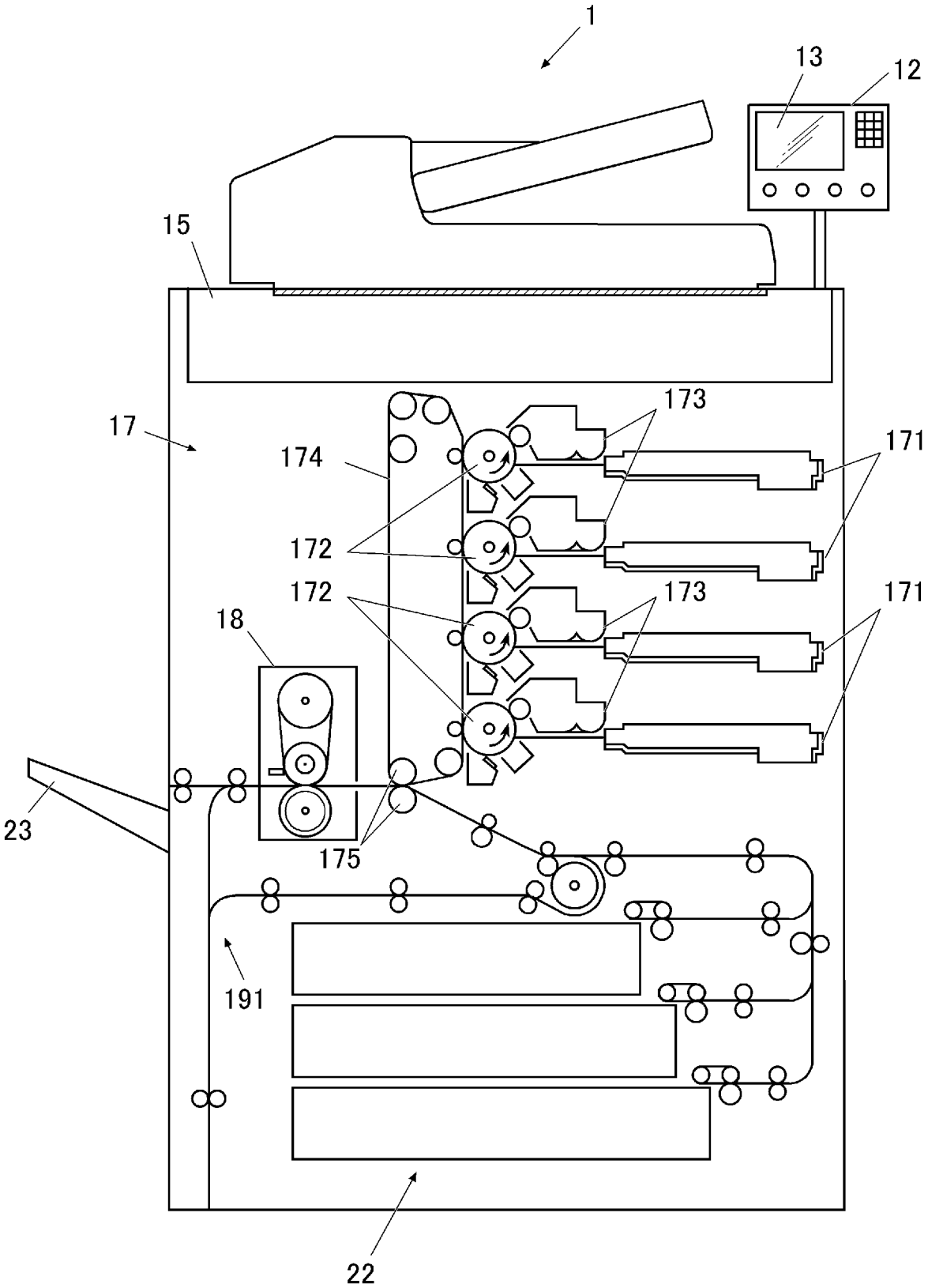
FIG. 1 schematically shows a configuration of an image forming apparatus.
Figure 2:
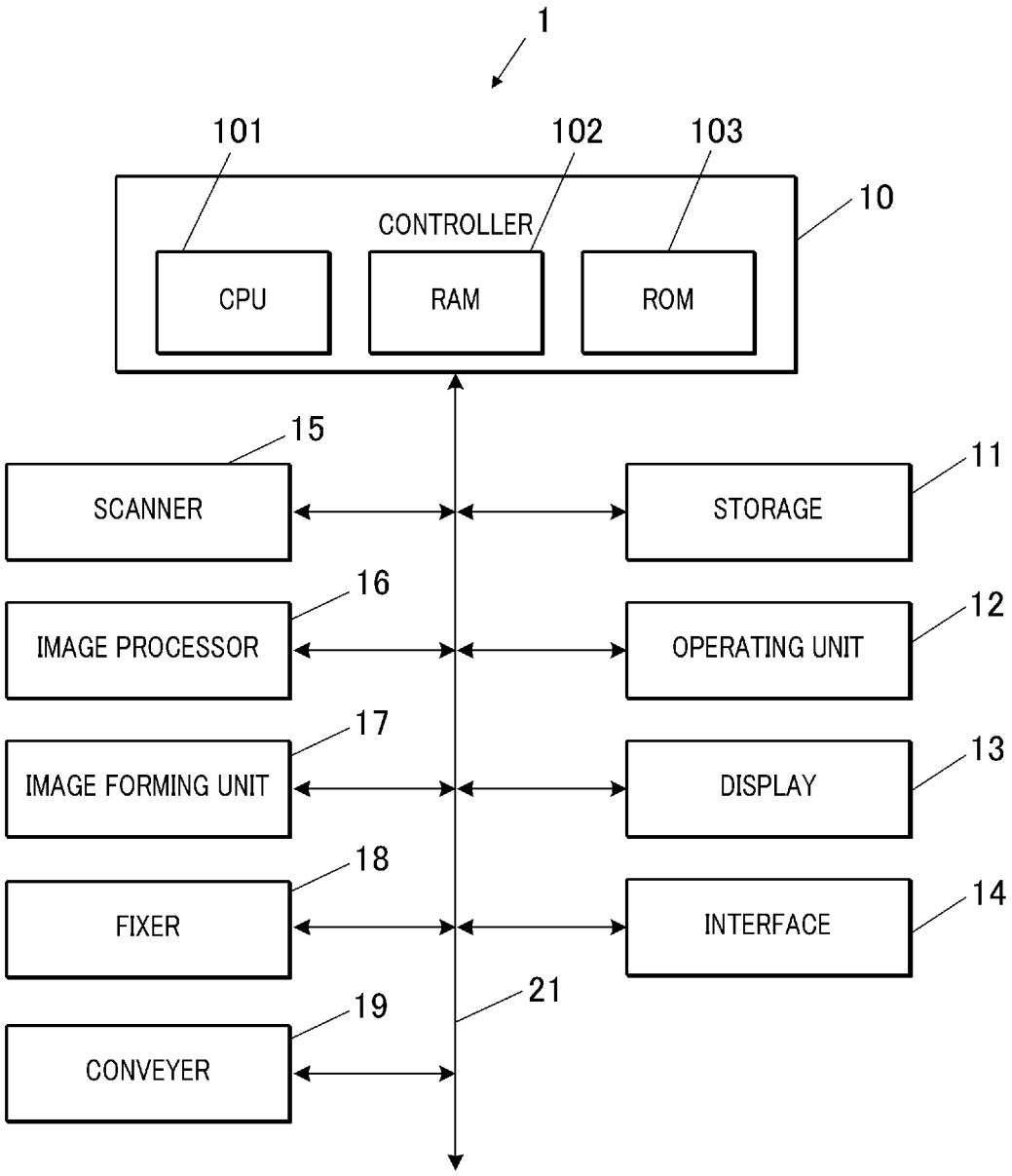
FIG. 2 is a block diagram showing a main functional configuration of the image forming apparatus.

FIG. 1 schematically shows a configuration of an image forming apparatus 1 according to a first embodiment of the present invention. FIG. 2 is a block diagram showing a main functional configuration of the image forming apparatus 1.

The image forming apparatus 1 includes: a controller 10 that includes a CPU 101 (Central Processing Unit), a RAM 102 (Random Access Memory), and a ROM 103 (Read Only Memory); a storage 11, an operating unit 12; a display 13; an interface 14; a scanner 15; an image processor 16; an image forming unit 17; a fixer 18; and a conveyer 19. The controller 10 is connected through a bus 21 to the storage 11, the operating unit 12, the display 13, the interface 14, the scanner 15, the image processor 16, the image forming unit 17, the fixer 18, and the conveyer 19.

The CPU 101 reads and executes a program stored in the ROM 103 or the storage 11 to perform a variety of arithmetic processing.

The RAM 102 provides a memory space for operation to the CPU 101 and temporarily stores data.

The ROM 103 stores a variety of programs being executed by the CPU 101, setting data, etc. It should be noted that the ROM 103 may be replaced by a non-volatile memory such as EEPROM (Electrically Erasable Programmable Read Only Memory) and flash memory.

The controller 10, which includes the CPU 101, the RAM 102, and the ROM 103, collectively controls components of the image forming apparatus 1 in accordance with the above-described variety of programs. For instance, the controller 10 executes a job in response to a job execution command input through the operating unit 12 or the interface 14, performing a control for forming a toner image on sheet P based on image data input through the scanner 15 or the interface 14. In addition, when the input execution command is intended for a job in a high-gloss mode, the controller 10 performs a fixing belt velocity control process A (described later) to control a surface velocity of a fixing belt 181 (see FIG. 3).

The storage 11, which is, for instance, a DRAM (Dynamic Random Access Memory), stores image data acquired by the scanner 15, image data externally input through the interface 14, etc. It should be noted that such image data, etc. may be stored in the RAM 102.

The operating unit 12 outputs a variety of information set by a user to the CPU 101 of the controller 10. The operating unit 12 may be a touch panel, which enables an input operation in accordance with, for instance, information appearing on a display. A user can set through the operating unit 12 printing conditions for a job, such as type of the sheet P (e.g., coated paper and plain paper) being used for the job, basis weight, size, sheet feed tray, image density, magnification, and presence or absence of a request for duplex printing. The set printing conditions are stored in the storage 11 or may be stored in the RAM 102. In addition, the user can input a job execution command, etc. through the operating unit 12.

The display 13, which includes a display device such as an LCD (Liquid crystal display), displays a state of the image forming apparatus 1 and contents of an operation input to the touch panel.

The interface 14, which is a unit that transmits and receives data between itself and an external computer or another image forming apparatus, is, for instance, one of a variety of serial interfaces.

The scanner 15 reads image on an original copy, generates image data containing monochromatic image data for each of color components, that is, R (red), G (green), and B (blue), and has the image data stored in the storage 11.

The image processor 16, which includes, for instance, a rasterizer, a color converter, a gradation corrector, and a halftone processor, performs a variety of image processing on the image data stored in the storage 11 and has the processed image data stored in the storage 11.

The image forming unit 17 forms an image on the fed sheet P based on the image data stored in the storage 11. The image forming unit 17 includes four sets of an exposure unit 171, a photosensitive body 172, and a developing unit 173 that correspond one-to-one to color components such as C (cyan), M (magenta), Y (yellow), and K (black). The image forming unit 17 also includes a transfer body 174 and secondary transfer rollers 175.

The exposure unit 171 includes a light emitting device or LD (Laser Diode). The exposure unit 171 drives the LD based on the image data, thereby irradiating (exposing) the photosensitive body 172, which is electrically charged, with a laser beam to form an electrostatic latent image on the photosensitive body 172. The developing unit 173 feeds a toner (color material) of a predetermined color (one of C, M, Y, and K) onto the exposed photosensitive body 172 using an electrically charged developing roller, thereby developing the electrostatic latent image formed on the photosensitive body 172.

Images (monochromatic images) formed by the toners of C, M, Y, and K, which are formed on the respective four photosensitive bodies 172 for C, M, Y, and K, are sequentially superimposed and transferred from the respective photosensitive bodies 172 onto the transfer body 174. A color image with the color components of C, M, Y, and K is thus formed on the transfer body 174. The transfer body 174, which is an endless belt wound around a plurality of transfer body conveyance rollers, rotates with the rotation of each of the transfer body conveyance rollers.

The secondary transfer rollers 175 transfer the color image on the transfer body 174 onto the sheet P fed from the sheet feed tray 22. Specifically, a predetermined transfer voltage is applied to the secondary transfer rollers 175 with the sheet P and the transfer body 174 being held therebetween, attracting the toners forming the color image on the transfer body 174 toward the sheet P to be transferred to the sheet P.

The fixer 18 performs a fixing process, where the sheet P with the toner image being transferred thereon is heated and pressed so that the toners are fixed to the sheet P.

Figure 3:
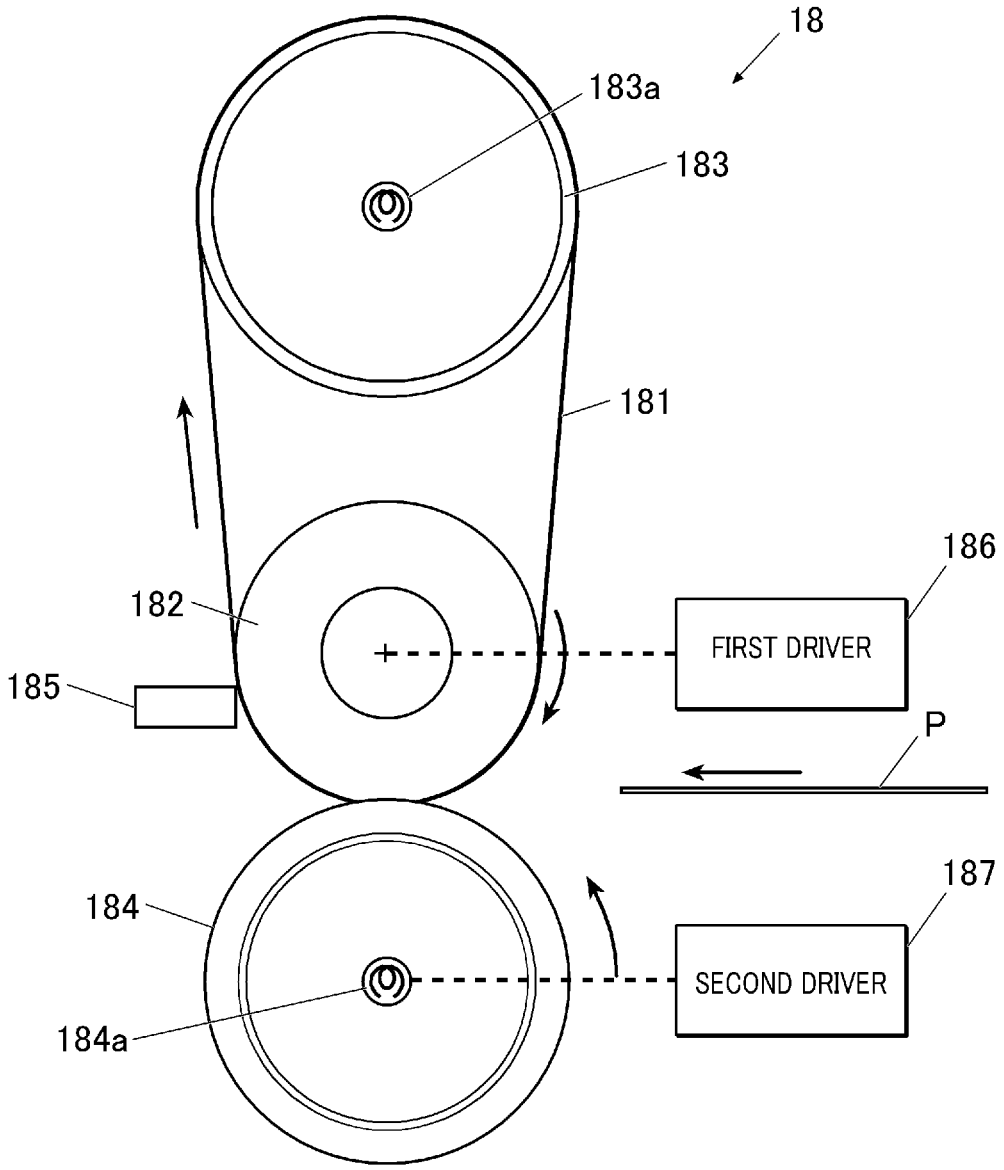
FIG. 3 is a schematic view showing a configuration of a fixer.

FIG. 3 is a schematic view showing configuration of the fixer 18. The fixer 18 includes a fixing belt (fixing rotation body) 181, a fixing roller 182, a heating roller 183, a pressure roller (pressing rotation body) 184, a velocity measurement unit 185, a first driver 186, and a second driver 187. The controller 10 is connected to, for instance, the first driver 186, the second driver 187, a heater 183*a* equipped in the heating roller 183, and a heater 184*a* equipped in the pressure roller 184 to control the components of the fixer 18.

The fixing belt 181, which is an endless belt with a width that is substantially the same as those of the fixing roller 182 and the heating roller 183, is tightly wound around the fixing roller 182 and the heating roller 183. The fixing belt 181 is driven via the fixing roller 182 to be turned in an arrow direction shown in FIG. 3 along the fixing roller 182 and the heating roller 183, heating the sheet P with the image being transferred thereon while conveying the sheet P.

The fixing belt 181 includes, for instance, a heat-resistant polyimide film base, and an elastic layer of a silicone rubber and a surface release layer of a fluorine resin that are sequentially layered on an outer peripheral surface of the film base. The fluorine resin contains or, preferably, consists mainly of any one of PFA (perfluoro alkoxy alkane), PTFE (polytetrafluoroethylene), and FEP (tetrafluoroethylene-hexafluoropropylene copolymer). This improves a surface releasability of the fixing belt 181 relative to a wax contained in toner resin or toner particles, preventing the toners from adhering to the fixing belt 181 when being fixed.

In this embodiment, an outer layer of the fixing belt 181 has an indentation hardness HIT of 3.5 N/mm$^2$ or less measured by nanoindentation. This is because a reduction in the hardness of the outer layer of the fixing belt increases a gloss control range.

The fixing roller 182, a shaft of which is connected to the first driver 186, is driven by the first driver 186 to rotate in an arrow direction shown in FIG. 3, causing the fixing belt 181 to rotate. In addition, the fixing roller 182 is in press-contact with the pressure roller 184 with the fixing belt 181 being therebetween, forming a fixing nip between the fixing belt 181 and the pressure roller 184.

The fixing roller 182 includes, for instance, a columnar core of iron or the like and an elastic layer of a silicone rubber or the like formed on an outer peripheral surface of the core. In addition, an outer peripheral surface of the elastic layer may be provided with a surface release layer of a fluorine resin as described above.

The heating roller 183, which includes therein the heater 183*a* that extends in a direction of a rotation axis of the heating roller 183, heats the fixing belt 181. Examples of the heater 183*a* include a halogen lamp heater, an IH heater, etc.

The pressure roller 184, a shaft of which is connected to the second driver 187, is driven by the second driver 187 to rotate in an arrow direction shown in FIG. 3. In addition, the pressure roller 184, which includes therein the heater 184*a*, is driven by a press-contact drive mechanism (not shown) to come into press-contact with the fixing roller 182 with the fixing belt 181 being therebetween, forming the fixing nip between the pressure roller 184 and the fixing belt 181 so that the sheet P with the toner image being transferred is heated and pressed while being held and fed to fix the toner image to the sheet P.

Similarly to the fixing roller 182, the pressure roller 184 includes, for instance, a columnar core of iron or the like and an elastic layer of a silicone rubber or the like formed on an outer peripheral surface of the core. In addition, an outer peripheral surface of the elastic layer may be provided with a surface release layer of a fluorine resin as described above. It should be noted that the pressure roller 184 is likely to be a solid body with the elastic layer thereof being thinner than that of the fixing roller 182. A change in the diameter of the pressure roller 184 due to temperature or use is small.

The velocity measurement unit 185 measures the surface velocity of the fixing belt 181 and outputs a measurement result to the controller 10. The velocity measurement unit 185 may be a velocity sensor using a laser Doppler technique or a device that puts outer layer marks with different reflectances on an outer layer of a fixing belt and detects a velocity based on time intervals at which the marks are detected using a reflective sensor.

The first driver 186, which is, for instance, a motor, causes the fixing roller 182 to rotate in accordance with a control value (e.g., rotation speed) input from the controller 10.

The second driver 187, which is, for instance, a motor, causes the pressure roller 184 to rotate in accordance with a control value (e.g., rotation speed) input from the controller 10.

Referring back to FIG. 1, the conveyer 19, which includes a plurality of sheet conveyance rollers that rotate with the sheet P being held therebetween to convey the sheet P, conveys the sheet P loaded from the sheet feed tray 22 along a predetermined conveyance route. The conveyer 19 includes an inversion mechanism 191 that inverts the sheet P subjected to the fixing process by the fixer 18 back to front and conveys the sheet P to the secondary transfer rollers 175. In forming an image on each of both surfaces of the sheet P by the image forming apparatus 1, the sheet P is ejected into a sheet ejection tray 23 after the sheet P is inverted back to front by the inversion mechanism 191 and an image is formed on each of both surfaces of the sheet P. In forming an image only on one surface of the sheet P, the sheet P with an image being formed on the one surface thereof is ejected into the sheet ejection tray 23 without having been inverted back to front by the inversion mechanism 191.

Operation of Image Forming Apparatus 1

Next, an operation of the image forming apparatus 1 will be explained.

The image forming apparatus 1 according to this embodiment is capable of operating in a standard mode or a high-gloss mode. The standard mode is a mode not intended to gloss the toner image formed on the sheet P, that is, a mode where a surface velocity of the sheet P passing through the fixing nip and the surface velocity of the fixing belt 181 are controlled such that almost no velocity difference is caused therebetween (such that both velocities become almost the same) when the fixing belt 181 is in press-contact with the pressure roller 184.

The high-gloss mode is a mode where the glossiness of the toner image formed on the sheet P is enhanced by making a velocity difference between the surface velocity of the sheet P passing through the fixing nip and the surface velocity of the fixing belt 181 to generate shear, when the fixing belt 181 is in press-contact with the pressure roller 184.

In this regard, in generating a shearing force by making a velocity difference between the surface velocity of the fixing belt 181 and the surface velocity of the sheet P or the pressure roller 184 in press-contact with the fixing belt 181, a large velocity difference damages the fixing belt 181 with the outer layer of the belt being deteriorated, causing image noise before the lifetime of the fixing belt 181 elapses. Accordingly, in this embodiment, when the pressure roller 184 is in press-contact with the fixing belt 181 during operation in the high-gloss mode, an absolute value V2 of a surface velocity difference between the fixing belt 181 and the pressure roller 184 during a time of no-sheet passing through the fixing nip, which is irrelevant to gloss control, is controlled to be smaller than an absolute value V1 of a surface velocity difference between the fixing belt 181 and the sheet P during a time of sheet passing, thereby reducing the deterioration of the fixing belt 181. Hereinafter, the "time of sheet passing" means the time when the sheet P passes through the fixing nip, whereas the "time of no-sheet passing" means the time when the sheet P does not pass through the fixing nip (the same applies to second to fifth embodiments).

It should be noted that when a typical type of paper for the use of printing (a type of paper not including a special heavy paper) is used as the sheet P, the surface velocity of the sheet P is almost the same as a surface velocity of the pressure roller 184. The surface velocity of the sheet P can thus be defined by the surface velocity of the pressure roller 184. Further, for instance, when a predetermined type of paper with a thickness exceeding a predetermined threshold is used as the sheet P, the surface velocity of the sheet P may be determined by adding a predetermined value corresponding to the thickness to the surface velocity of the pressure roller 184.

Figure 4:
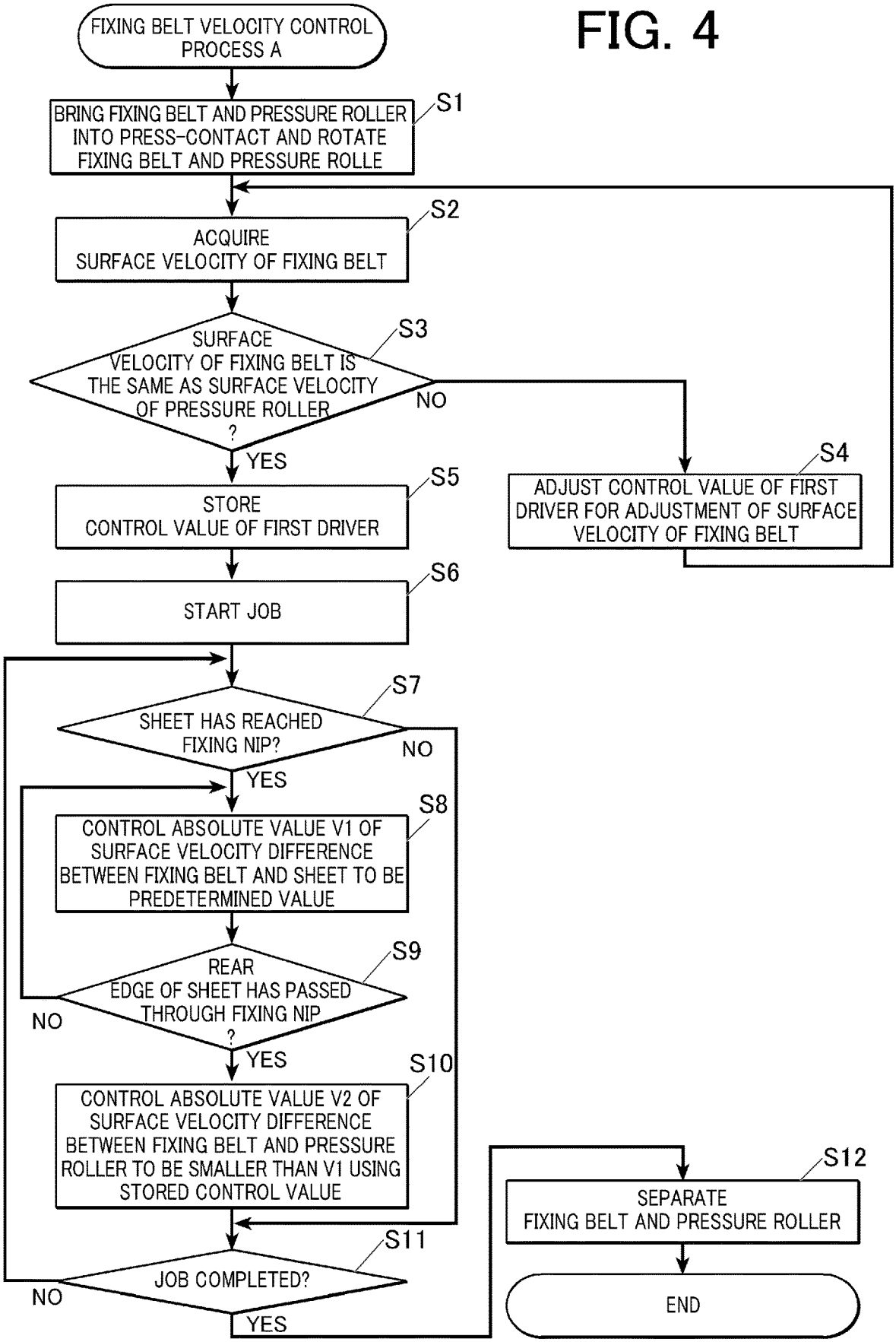
FIG. 4 is a flowchart showing a fixing belt velocity control process A being performed by a controller shown in FIG. 2.

FIG. 4 is a flowchart showing a fixing belt velocity control process A being performed by the controller 10. The fixing belt velocity control process A is performed in response to a job execution command in the high-gloss mode.

First, the controller 10 performs Steps S1 to S5 to adjust the fixing belt surface velocity (the control value of the first driver 186) for the time of no-sheet passing in the high-gloss mode.

In Step S1, the controller 10 causes the pressure roller 184 to come into press-contact with the fixing belt 181, and causes the fixing roller 182 and the pressure roller 184 to rotate by inputting the control value for the high-gloss mode corresponding to job conditions to each of the first driver 186 and the second driver 187 (Step S1).

The control value for the high-gloss mode means a control value for the time of sheet passing in the high-gloss mode. In contrast, a control value for the time of no-sheet passing in the high-gloss mode is referred to as a control value for the time of no-sheet passing. The respective control values of the first driver 186 and the second driver 187 for the high-gloss mode are stored in advance in the ROM 103 or the storage 11 for each of conditions such as paper type and basis weight. The respective controls values of the first driver 186 and the second driver 187 for the high-gloss mode are set in advance such that the absolute value V1 of the velocity difference between the surface velocity of the fixing belt 181 driven with the control values and the surface velocity of the sheet P reaches a predetermined value (V1>0) (the same applies to the second to fifth embodiments).

Subsequently, the controller 10 acquires a measurement result of the surface velocity of the fixing belt 181 provided by the velocity measurement unit 185 (Step S2).

Subsequently, the controller 10 determines whether the surface velocity of the fixing belt 181 is the same as the surface velocity of the pressure roller 184 (Step S3).

In this regard, the pressure roller 184 is likely to be a solid body with the outer layer thereof being thinned as described above, so that a change in the diameter of the pressure roller 184 due to temperature or use is sufficiently small. Thus, the surface velocity of the pressure roller 184 can be calculated from the control value input to the second driver 187 without the necessity of measuring the surface velocity of the pressure roller 184. It should be noted that a velocity measurement unit for measuring the surface velocity of the pressure roller 184 may be provided to acquire the surface velocity of the pressure roller 184.

In contrast, the fixing belt 181 experiences a change in a diameter of the fixing roller 182, a change in a friction coefficient between a belt rear surface and the fixing roller 182, and a change in a friction coefficient between the outer layer of the pressure roller 184 and a belt front surface as a result of use, so that the surface velocity of the fixing belt 181 is not always constant for the control value input to the first driver 186. Thus, it is preferable that the surface velocity is measured by the velocity measurement unit 185 for a control with a higher accuracy. However, the measurement by the velocity measurement unit 185 is not necessary for a system with a long lifetime setting or time to elapse before deterioration.

It should be noted that when there is only a slight difference (a predetermined range or less) between the surface velocity of the fixing belt 181 and the surface velocity of the pressure roller 184, the surface velocity of the fixing belt 181 is determined to be the same as the surface velocity of the pressure roller 184 in Step S3.

If the surface velocity of the fixing belt 181 is not equal to the surface velocity of the pressure roller 184 (Step S3; NO), the controller 10 adjusts the surface velocity of the fixing belt 181 (Step S4). The process then returns to Step S2.

In Step S4, the control value of the first driver 186, which drives the fixing roller 182, is adjusted such that the surface velocity of the fixing belt 181 becomes closer to (substantially the same as) the surface velocity of the pressure roller 184. For instance, the adjusted control value of the first driver 186 is calculated by (Expression 1) below.

an adjusted control value of the first driver 186=an unadjusted control value of the first driver 186× (the surface velocity of the pressure roller 184/ the measured surface velocity of the fixing belt 181) (Expression 1)

It should be noted that the adjusted control value may be calculated from a relationship between a plurality of the latest control values of the first driver 186 and the surface velocities of the fixing belt 181 by an approximate expression and a method of adjusting the first driver 186 is not limited to (Expression 1).

Further, it is preferable that the control value of the first driver 186 is adjusted such that a magnitude relationship between the surface velocity of the fixing belt 181 and the surface velocity of the pressure roller 184 during the time of no-sheet passing becomes the same as a magnitude relationship between the surface velocity of the fixing belt 181 and the surface velocity of the sheet P during the time of sheet passing.

Figure 5A:
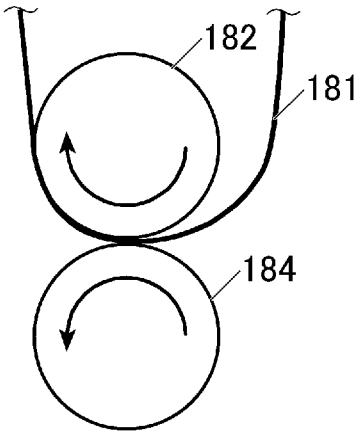
FIG. 5A schematically shows a state of a fixing belt upstream and downstream of a fixing nip at a fixing belt surface velocity<a pressure roller surface velocity (a surface velocity of sheet P)
Figure 5B:
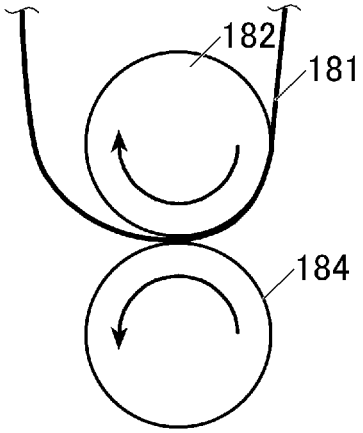
FIG. 5B schematically shows a state of the fixing belt upstream and downstream of the fixing nip at the fixing belt surface velocity>the pressure roller surface velocity (the surface velocity of the sheet P)

FIG. 5A schematically shows a state of the fixing belt 181 upstream and downstream of the fixing nip at the fixing belt surface velocity<the pressure roller surface velocity (the surface velocity of the sheet P), and FIG. 5B schematically shows a state of the fixing belt upstream and downstream of the fixing nip at the fixing belt surface velocity>the pressure roller surface velocity (the surface velocity of the sheet P). As shown in FIGS. 5A and 5B, a change in the magnitude relationship between the surface velocity of the fixing belt 181 and the surface velocity of the pressure roller 184 or the sheet P, which is in press-contact with the fixing belt 181, results in a change in whether the fixing belt 181 is loosened upstream or downstream. It is thus speculated that a change in the magnitude relationship between the surface velocities of the fixing belt 181 and the sheet P during the time of sheet passing and a change in the magnitude relationship between the surface velocities of the fixing belt 81 and the pressure roller 184 during the time of no-sheet passing cause the flapping of the fixing belt 181, applying an unnecessary load to the fixing belt. Accordingly, for transition from the time of sheet passing to the time of no-sheet passing, it is preferable that the control value of the first driver 186 is adjusted such that the magnitude relationship between the surface velocities of the fixing belt 181 and the pressure roller 184 during the time of no-sheet passing becomes the same as the magnitude relationship between the surface velocities of the fixing belt 181 and the sheet P during the time of sheet passing.

If the surface velocity of the fixing belt 181 is equal to the surface velocity of the pressure roller 184 (Step S3; YES), the controller 10 determines the adjusted control value of the first driver 186 as a control value for the time of no-sheet passing and stores the control value in the RAM 102 (Step S5). The process then proceeds to Step S6.

In Step S6, the controller 10 starts a job (Step S6) and determines whether a front edge of the sheet P has reached the fixing nip (Step S7). It may be determined whether the front edge of the sheet P has reached the fixing nip based on, for instance, a result of detection by a sensor such as an optical sensor (not shown) located upstream of the fixing nip in a sheet-conveyance direction.

If the sheet P has not reached the fixing nip (Step S7; NO), the process by the controller 10 proceeds to Step S11.

When the sheet P is determined to have reached the fixing nip (Step S7; YES), the controller 10 inputs the control value for the high-gloss mode to the first driver 186 to control the absolute value V1 of the surface velocity difference between the fixing belt 181 and the sheet P to be a predetermined value (Step S8).

Subsequently, the controller 10 waits for a rear edge of the sheet P to pass through the fixing nip (Step S9). It may be determined whether the rear edge of the sheet P has passed through the fixing nip based on, for instance, a result of detection by a sensor such as an optical sensor (not shown) located downstream of the fixing nip in the sheet-conveyance direction.

If the rear edge of the sheet p has passed through (Step S9; YES), the process by the controller 10 proceeds to Step S10.

In Step S10, the controller 10 inputs the control value for the time of no-sheet passing to the first driver 186 to control the absolute value V2 of the surface velocity difference between the fixing belt 181 and the pressure roller 184 to be smaller than the absolute value V1 (Step S10). The process then proceeds to Step S11.

In Step S11, the controller 10 determines whether the job has been completed (Step S11).

If the job has not been completed (Step S11; NO), the process by the controller 10 returns to Step S7.

If the job has been completed (Step S11; YES), the controller 10 causes the fixing belt 181 and the pressure roller 184 to be separated from each other (Step S12) and terminates the fixing belt velocity control process A.

Verification Experiments for First Embodiments

To verify the effects of the first embodiment, verification experiments (Experiments 1 to 6) were conducted. Basic conditions common to the experiments are as follows.

Basic Conditions

Sheet: POD gloss coat 128 g/m$^2$

Fixing belt diameter: 120 in diameter

Fixing belt temperature: 180° C.

Outer layer of the fixing belt: indentation hardness HIT of 3.5 N/mm$^2$ as measured by nanoindentation Heating roller diameter: 58 in diameter Fixing roller diameter: 70 in diameter Thickness of the elastic layer of the fixing roller: t20

Pressure roller diameter: 70 in diameter

Thickness of the elastic layer of the pressure roller: t3

Pressure roller velocity (surface velocity): 500 mm/s

Sheet interval length: 90 mm

Sheet interval time: 0.18 seconds

Job interval: 10 seconds

In the experiments, 100 printing jobs were repeatedly executed in the high-gloss mode by an image forming apparatus including a fixer that satisfied the above basic conditions. After the operations of Steps S1 to S5 in FIG. 4 were performed at the beginning of each job (job interval) and the operations of Steps S6 to S12 in FIG. 4 were performed during job execution, the number of prints reached when noise occurred in an image was counted (Experiments 1 to 6). In addition, 100 printing jobs were repeatedly executed in the standard mode for Comparative Examples (Refs 1 to 2).

Meanwhile, since the surface velocity of the sheet≈the surface velocity of the pressure roller 184, the surface velocity of the sheet was defined as the pressure roller surface velocity.

Table I shows respective conditions unique to the experiments and experimental results. It should be noted that in Experiments 1 to 6, the control value for the high-gloss mode was set for the first driver 186 such that the fixing belt surface velocity (mm/s) (simply referred to as belt velocity in Table I, and also in Table II to Table VI) for each of the time of sheet passing and the time of no-sheet passing in each experiment became a value shown in Table I and, furthermore, it was determined in Step S3 in FIG. 4 whether the fixing belt surface velocity was the same as the value for the time of no-sheet passing shown in Table I.

TABLE I

| | Sheet passing Belt velocity | No sheet passing Belt velocity | Absolute value of velocity difference from pressure roller | Noise occurrence point (×1000) | Experiment No. |
|---|---|---|---|---|---|
| High-gloss mode | 515 | 515 | 15 | 500 | 1 |
| | | 495 | 5 | 600 | 2 |
| | | 505 | 5 | 700 | 3 |
| High-gloss mode | 485 | 485 | 15 | 500 | 4 |
| | | 505 | 5 | 600 | 5 |
| | | 495 | 5 | 700 | 6 |
| Standard mode | 503 | 503 | 3 | 1000 | Ref 1 |
| | 497 | 497 | 3 | 1000 | Ref 2 |

Each of Experiments 1 to 3 is an experiment for a case where the fixing belt surface velocity during the time of sheet passing is larger than the pressure roller surface velocity. Experiment 1 relates to a case where the absolute value of the surface velocity difference between the fixing belt 181 and the pressure roller 184 during the time of no-sheet passing is the same as that during the time of sheet passing. Experiments 2 and 3 each relate to a case where the absolute value of the surface velocity difference between the fixing belt 181 and the pressure roller 184 during the time of no-sheet passing is smaller than that during the time of sheet passing. Each of Experiments 4 to 6 is an experiment for a case where the fixing belt surface velocity during the time of sheet passing is smaller than the pressure roller surface velocity. Experiment 4 relates to a case where the absolute value of the surface velocity difference between the fixing belt 181 and the pressure roller 184 during the time of no-sheet passing is the same as that during the time of sheet passing. Experiments 5 and 6 each relate to a case where the absolute value of the surface velocity difference between the fixing belt 181 and the pressure roller 184 during the time of no-sheet passing is smaller than that during the time of sheet passing.

As shown in Table I, Experiments 2 and 3 achieved a further reduction in image noise (a further delay in the time of occurrence of image noise) than Experiment 1 and Experiments 5 and 6 achieved a further reduction in image noise than Experiment 4. In other words, it has been demonstrated that controlling the absolute value of the surface velocity difference between the fixing belt 181 and the pressure roller 184 during the time of no-sheet passing, which is irrelevant to gloss control, to be smaller than the absolute value of the surface velocity difference between the fixing belt 181 and the pressure roller 184 (sheet P) during the time of sheet passing can reduce the deterioration of the fixing belt 181 and, consequently, reduce image noise.

Further, Experiment 3 and Experiment 6 resulted in a more excellent noise reducing effect than Experiment 2 and Experiment 5, respectively. This is supposed to be because while the magnitude relationship between the surface velocity of the fixing belt 181 and the surface velocity of the pressure roller 184 changed during transition from the time of sheet passing to the time of no-sheet passing in Experiments 2 and 5, the magnitude relationship between the surface velocity of the fixing belt 181 and the surface velocity of the pressure roller 184 did not change during transition from the time of sheet passing to the time of no-sheet passing in Experiments 3 and 6, thus reducing the flapping of the fixing belt 181 and, consequently, reducing a load applied to the fixing belt 181 more in Experiments 3 and 6.

Furthermore, by moderately changing the control value of the first driver 186, which drives the fixing roller 182, for the time of no-sheet passing from the value for the time of sheet passing to the adjusted value, the time of occurrence of image noise was delayed by another approximately 20 (thousand sheets) with respect to the respective results of Experiments 1 to 6 in Table I.

Second Embodiment

A second embodiment of the present invention will be described below.

While the first embodiment is explained with reference to the instance where the control value of the first driver 186 for the time when no-sheet passes through the fixer 18 is adjusted for each job, the second embodiment will be explained with reference to an instance where the previously adjusted control value is continuously used.

In the second embodiment, while storing the respective control values of the first driver 186 and the second driver 187 for the high-gloss mode for each of conditions (in association with each of conditions) such as paper type and basis weight, the storage 11 is also provided with an area for storing a last (previously) adjusted value of the control value of the first driver 186 for the time of no-sheet passing.

Since the other components of the image forming apparatus 1 are the same as those explained in the first embodiment, the explanations thereof are incorporated by reference and an operation according to the second embodiment will be explained below.

FIG. 6 is a flowchart showing a fixing belt velocity control process B being performed by the controller 10 according to the second embodiment. The fixing belt velocity control process B is performed in response to a job execution command in the high-gloss mode.

First, the controller 10 determines whether the storage 11 stores the control value of the first driver 186 for the time of no-sheet passing corresponding to job conditions such as paper type and basis weight (Step S21).

If the control value of the first driver 186 for the time of no-sheet passing corresponding to the job conditions is not stored (Step S21; NO), the controller 10 performs operations of Steps S22 to S25, adjusting the control value of the first driver 186 for the time of no-sheet passing and storing the adjusted control value in association with the each of job conditions such as paper type and basis weight in a predetermined storage area of the storage 11 (Step S26). The process then proceeds to Step S27. Since the operations of Steps S22 to S25 are the same as those of Steps S1 to S4 in FIG. 4, the explanations thereof are incorporated by reference.

If the control value of the first driver 186 for the time of no-sheet passing corresponding to the job conditions is stored (Step S21; YES), the process proceeds to Step S27.

In Step S27, the controller 10 starts a job, performing operations of Steps S28 to S33. Since the operations of Steps S28 to S33 are the same as those of Steps S7 to S12 in FIG. 4, the explanations thereof are incorporated by reference. It should be noted that when the fixing belt 181 and the pressure roller 184 do not rotate while being in press-contact with each other (in Step S21, the determination result is NO), the controller 10 causes the fixing belt 181 and the pressure roller 184 to rotate while being in press-contact with each other at the start of the job. In addition, in Step S31, the controller 10 reads the control value for the time of no-sheet passing corresponding to the job conditions stored in the storage 11 and inputs the control value to the first driver 186. At the completion of the operations of Steps S28 to S33, the controller 10 terminates the fixing belt velocity control process B.

Verification Experiments for Second Embodiment

To verify the effects of the second embodiment, verification experiments (Experiments 7 to 12) were conducted. Basic conditions common to the experiments were the same as those of the first embodiment.

In the experiments, 100 printing jobs were repeatedly executed in the high-gloss mode by the image forming apparatus 1 including a fixer that satisfied the above basic conditions. After the operations of Steps S21 to S26 in FIG. 6 were performed at the beginning of each job (job interval) and the operations of Steps S27 to S33 in FIG. 6 were performed during job execution, the number of prints reached when noise occurred in an image was counted. In other words, the fixing belt surface velocity (the control value of the first driver 186) for the time of no-sheet passing was adjusted at the beginning of the first job, and the calculated control value was continuously used for the second and subsequent jobs.

Meanwhile, since the surface velocity of the sheet the surface velocity of the pressure roller 184, the surface velocity of the sheet was defined as the pressure roller surface velocity.

Table II shows respective conditions unique to the experiments and experimental results. In Experiments 7 to 12, the control value of the first driver 186 for the high-gloss mode was set such that the fixing belt surface velocity for each of the time of sheet passing and the time of no-sheet passing became a value shown in Table II and, furthermore, it was determined in Step S24 in FIG. 6 whether the fixing belt surface velocity was the same as the value for the time of no-sheet passing shown in Table II. It should be noted that the fixing belt surface velocities in Experiments 7 to 12 for each of the time of sheet passing and the time of no-sheet passing are the same as those in Experiments 1 to 6, respectively.

TABLE II

| | Sheet passing Belt velocity | No sheet passing Belt velocity | Absolute value of velocity difference from pressure roller | Noise occurrence point (×1000) | Experiment No. |
|---|---|---|---|---|---|
| High-gloss mode | 515 | 515 | 15 | 550 | 7 |
| | | 495 | 5 | 650 | 8 |
| | | 505 | 5 | 750 | 9 |
| High-gloss mode | 485 | 485 | 15 | 550 | 10 |
| | | 505 | 5 | 650 | 11 |
| | | 495 | 5 | 750 | 12 |

As shown in Table II, Experiments 7 to 12 achieved larger noise reducing effects (achieved a further delay in the time of occurrence of image noise) than Experiments 1 to 6 shown in Table I, respectively. This is supposed to be because that in Experiments 7 to 12, the surface velocity of the fixing belt 181 for the time of no-sheet passing was adjusted for the first job but not adjusted for the second and subsequent jobs, thereby reducing time when the fixing belt and the pressure roller were in press-contact with each other as compared with in Experiments 1 to 6 and, consequently, reducing damage to the fixing belt.

Third Embodiment

A third embodiment of the present invention will be explained below.

While the second embodiment is explained with reference to the instance where the adjusted control value of the first driver 186 for the time of no-sheet processing was continuously used, the third embodiment will be explained with reference to an instance where a control value used for a job is determined by prediction based on the previously adjusted control value.

In the third embodiment, while storing the respective control values of the first driver 186 and the second driver 187 for the high-gloss mode for each of conditions (in association with each of conditions) such as paper type and basis weight, the storage 11 is also provided with an area for storing control values of the first driver 186 acquired by a predetermined number (two or more) of previous adjustments for the time of no-sheet passing for each of conditions such as paper type and basis weight in association with fixing belt surface velocities resulting from the control values and counter values (e.g., the number of prints) at the time of the adjustments.

Since the other components of the image forming apparatus 1 are the same as those explained in the first embodiment, the explanations thereof are incorporated by reference and an operation according to the third embodiment will be explained below.

FIG. 7 is a flowchart showing a fixing belt velocity control process C being performed by the controller 10 according to the third embodiment. The fixing belt velocity control process C is performed in response to a job execution command in the high-gloss mode.

First, the controller 10 determines whether the storage 11 stores at least a predetermined number of previous control values of the first driver 186 for the time of no-sheet passing corresponding to job conditions such as paper type and basis weight (Step S41).

If at least the predetermined number of previous control values of the first driver 186 for the time of no-sheet passing corresponding to the job conditions are not stored (Step S41; NO), the controller 10 performs operations of Steps S42 to S45, adjusting the control value of the first driver 186 for the time of no-sheet passing and storing the adjusted control value in a predetermined storage area of the storage 11 in association with each of job conditions such as paper type and basis weight, a fixing belt surface velocity resulting from this control value, and a counter value at the time of the adjustment (Step S46). The process then proceeds to Step S48. Since the operations of Steps S42 to S45 are the same as those of Steps S1 to S4 in FIG. 4, the explanations thereof are incorporated by reference.

If at least the predetermined number of control values of the first driver 186 for the time of no-sheet passing corresponding to the job conditions are stored (Step S41; YES), a control value being used for the current job is predicted by, for instance, an approximate expression based on a relationship between the previous control values of the first driver 186 for the time of no-sheet passing corresponding to the job conditions and the fixing belt surface velocities stored in the storage 11, and the predicted control value is stored in the RAM 102 (Step S47). The process then proceeds to Step S48.

In Step S48, the controller 10 starts the job and performs operations of Steps S49 to S54. Since the operations of Steps S49 to S54 are the same as those of Steps S7 to S12 in FIG. 4, the explanations thereof are incorporated by reference. It should be noted that when the fixing belt 181 and the pressure roller 184 do not rotate while being in press-contact with each other (in Step S41, the determination result is NO), the controller 10 causes the fixing belt 181 and the pressure roller 184 to rotate while being in press-contact with each other at the start of the job. In addition, in Step S52, the controller 10 reads the control value for the time of no-sheet passing corresponding to the job conditions stored in the storage 11 (when adjustment is performed) or the predicted control value stored in the RAM 102 (when prediction is performed), and inputs the read control value to the first driver 186. At the completion of the operations of Steps S49 to S54, the controller 10 terminates the fixing belt velocity control process C.

Verification Experiments for Third Embodiment

To verify the effects of the third embodiment, verification experiments (Experiments 13 to 18) were conducted. Basic conditions common to the experiments were the same as those of the first embodiment.

In each experiment, 100 printing jobs were repeatedly executed in the high-gloss mode by the image forming apparatus 1 including the fixer 18 that satisfied the above basic conditions. After the operations of Steps S41 to S47 in FIG. 7 were performed at the beginning of each job (job interval) and the operations of Steps S48 to S54 in FIG. 7 were performed during job execution, the number of prints reached when noise occurred in an image was counted. In other words, the fixing belt surface velocity (the control value of the first driver 186) for the time of no-sheet passing was adjusted at the beginning of the predetermined number of jobs and, for the jobs subsequent thereto, a control value for the job was predicted by linear approximation based on the relationship between the controls values calculated for the previous jobs and the fixing belt surface velocities.

Meanwhile, since the surface velocity of the sheet the surface velocity of the pressure roller 184, the surface velocity of the sheet was defined as the pressure roller surface velocity.

Table III shows respective conditions unique to the experiments and experimental results. In Experiments 13 to 18, the control value of the fixing roller for the high-gloss mode was set such that the fixing belt surface velocity for each of the time of sheet passing and the time of no-sheet passing became a value shown in Table III and, furthermore, it was determined in Step S44 in FIG. 7 whether the fixing belt surface velocity was the same as the value for the time of no-sheet passing shown in Table III. It should be noted that the fixing belt surface velocities in Experiments 13 to 18 for each of the time of sheet passing and the time of no-sheet passing are the same as those in Experiments 1 to 6 and Experiments 7 to 12, respectively.

TABLE III

| | Sheet passing Belt velocity | No sheet passing Belt velocity | Absolute value of velocity difference from pressure roller | Noise occurrence point (×1000) | Experiment No. |
|---|---|---|---|---|---|
| High-gloss mode | 515 | 515 | 15 | 560 | 13 |
| | | 495 | 5 | 660 | 14 |
| | | 505 | 5 | 760 | 15 |
| High-gloss mode | 485 | 485 | 15 | 560 | 16 |
| | | 505 | 5 | 660 | 17 |
| | | 495 | 5 | 760 | 18 |

As shown in Table III, Experiments 13 to 18 achieved larger noise reducing effects (achieved a further delay in the time of occurrence of image noise) than Experiments 1 to 6 and Experiments 7 to 12, respectively. This is supposed to be because that in Experiments 13 to 18, the surface velocity of the fixing belt 181 was adjusted for the predetermined number of jobs but not adjusted for the subsequent jobs, thereby reducing time when the fixing belt 181 and the pressure roller 184 are in press-contact with each other with a velocity difference as compared with in Experiments 1 to 6 and, consequently, reducing damage to the fixing belt 181. Furthermore, while the surface velocity of the fixing belt 181 experienced, even when controlled with the same control value, a change in the surface velocity thereof with a change in a friction coefficient between the front surface of the fixing belt and the pressure roller and a change in a friction coefficient between the rear surface of the fixing belt and the fixing roller as a result of use, Experiments 13 to 18, in which the control value was predicted in consideration of the change in the surface velocity of the fixing belt 181, achieved minimization of velocity deviation, thus effectively reducing damage to the fixing belt 181.

Fourth Embodiment

A fourth embodiment of the present invention will be described below.

As described above, even when controlled with the same control value, the fixing belt 181 experiences a change in the surface velocity thereof with a change in the friction coefficient between the front surface of the fixing belt and the pressure roller and a change in the friction coefficient between the rear surface of the fixing belt and the fixing roller as a result of use. In this regard, in the image forming apparatus 1, for instance, fixing rate and fixing temperature are changed in accordance with conditions such as the paper type and basis weight of the sheet P used for the job. For the operation according to the second embodiment or the third embodiment, the control values of the first driver 186 for the time of no-sheet passing associated with conditions that are frequently used are adjusted from respective initial values (herein, the control values for the high-gloss mode), whereas the control values associated with conditions that are hardly used by a user remain the same as respective initial values. Furthermore, even the control values for some conditions adjusted from the respective initial values, that is, the previously adjusted control values would be unsuitable for the current situation if the state of the apparatus has been changed with time elapsed since the adjustment. The image forming apparatus 1, that is, an image forming apparatus that achieves the high-gloss mode using a shearing force generated by a difference between the fixing belt surface velocity and the surface velocity of the sheet P causes a large shear as a result of the use of the fixing belt surface velocity. Thus, controlling the apparatus with a control value unsuitable for the current situation, for instance, in the last phase of the durable time sometimes results in a partial damage to the fixing belt 181.

Accordingly, the fourth embodiment provides an adjustment mode for adjusting the control value of the first driver 186 for the time of no-sheet passing in the high-gloss mode upon detecting a predetermined state, such as detecting that the number of prints reaches a durable number of prints or that a motor torque of the pressure roller 184 (a torque of the second driver 187) changes.

It should be noted that a change in the surface velocity of the pressure roller 184 is small as compared with that of the fixing belt 181 as described above. However, since shear is sometimes caused as a result of a long time use, it is preferable that the control value of the second driver 187, which drives the pressure roller 184, is also adjusted as explained below.

Figure 8:
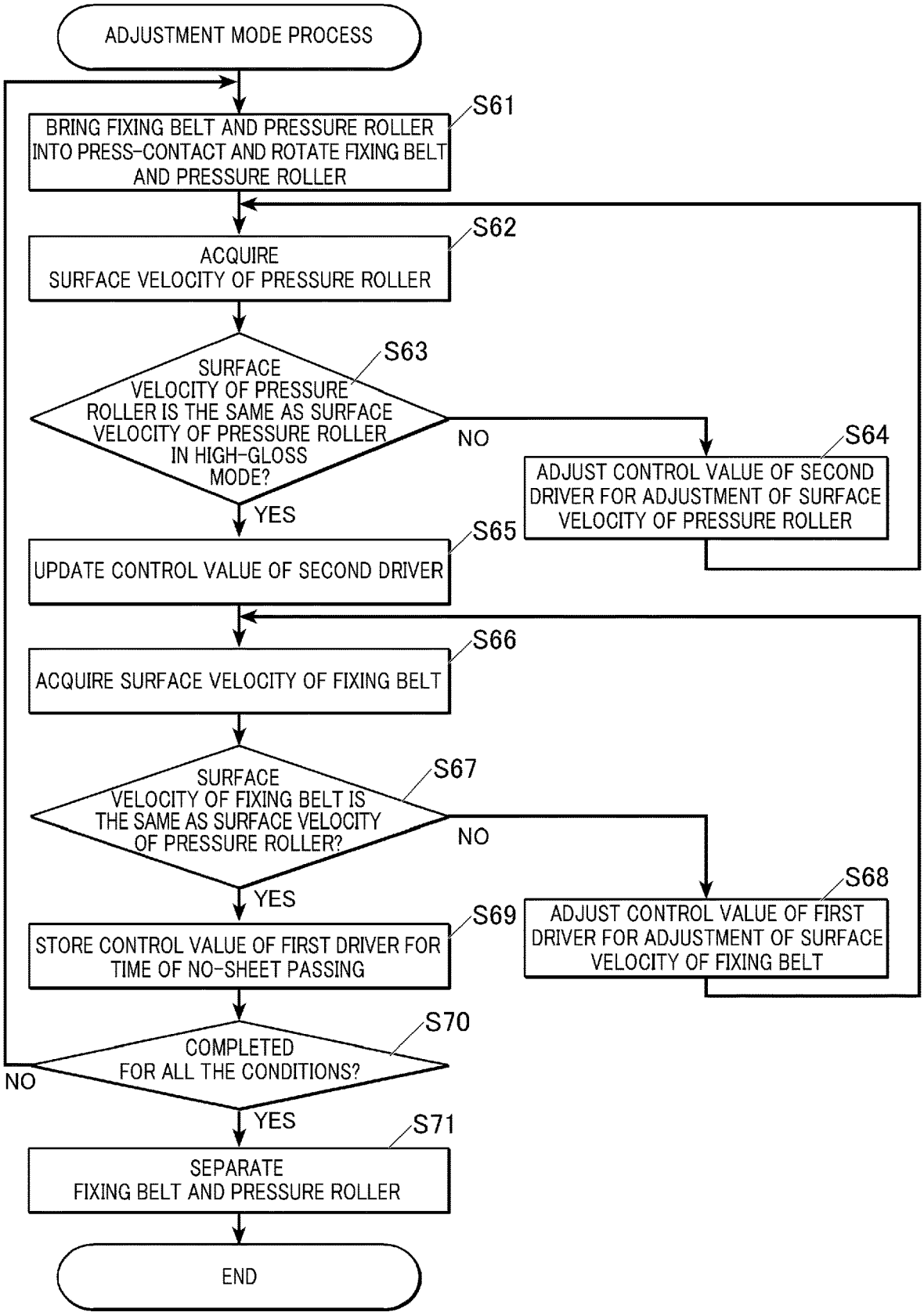
FIG. 8 is a flowchart showing an adjustment mode process being performed by the controller shown in FIG. 2.

In the fourth embodiment, a program for performing the adjustment mode process shown in FIG. 8 is stored in the ROM 103. In addition, a program for performing the fixing belt velocity control process B shown in FIG. 6 or the fixing belt velocity control process C shown in FIG. 7 is also stored.

Furthermore, while storing, for each of conditions such as paper type and basis weight (in association with each condition), the fixing belt surface velocity and pressure roller surface velocity for the high-gloss mode and the respective control values of the first driver 186 and the second driver 187, the storage 11 is also provided with an area for storing, for each of conditions such as paper type and basis weight, a control value of the first driver 186 for the time of no-sheet passing acquired by previous adjustments (a fixing belt surface velocity at the control value and a counter value at the time of the adjustment).

Furthermore, the velocity measurement unit 185 also measures the surface velocity of the pressure roller 184 and includes a sensor that outputs a measurement result to the controller 10.

Since the other components according to the fourth embodiment are the same as those explained in the first to third embodiments, the explanations thereof are incorporated by reference and an operation according to the fourth embodiment will be explained.

In the fourth embodiment, the controller 10 performs the above-described fixing belt velocity control process B or fixing belt velocity control process C in response to the input of a job execution command in the high-gloss mode.

In addition, the controller 10 performs the adjustment mode process when detecting the predetermined state. The predetermined state refers to, for instance, a state in the last phase of the durable time, where the number of prints reaches a durable number of prints or a motor torque of the pressure roller 184 changes FIG. 8 is a flowchart showing the adjustment mode process being performed by the controller 10 according to the fourth embodiment.

First, while causing the pressure roller 184 to come into press-contact with the fixing belt 181, the controller 10 selects conditions such as paper type and basis weight and inputs control values for the high-gloss mode corresponding to the selected conditions to the first driver 186 and the second driver 187 for rotation of the fixing roller 182 and the pressure roller 184 (Step S61).

Subsequently, the controller 10 acquires the measurement result of the surface velocity of the pressure roller 184 from the velocity measurement unit 185 (Step S62).

Subsequently, the controller 10 determines whether the measured surface velocity of the pressure roller 184 is the same as the pressure roller surface velocity for the high-gloss mode stored in the storage 11 (Step S63).

If the surface velocity of the pressure roller 184 is not equal to the pressure roller surface velocity for the high-gloss mode (Step S63; NO), the controller 10 adjusts the surface velocity of the pressure roller 184 (Step S64). The process then returns to Step S62.

In Step S64, the control value of the second driver 187, which drives the pressure roller 184, is adjusted such that the surface velocity of the pressure roller 184 reaches the pressure roller surface velocity for the high-gloss mode. For instance, the adjusted control value of the second driver 187 is calculated by (Expression 2) below.

an adjusted control value of the second driver 187=an unadjusted control value of the second driver 187×(the pressure roller surface velocity for the high-gloss mode/the measured surface velocity of the pressure roller 184) (Expression 2)

If the surface velocity of the pressure roller 184 is equal to the pressure roller surface velocity for the high-gloss mode (Step S63; YES), the controller 10 updates the control value of the second driver 187 stored in the storage 11 with the adjusted control value of the second driver 187 (Step S65). The process then proceeds to Step S66.

In Step S66, the measurement result of the surface velocity of the fixing belt 181 is acquired from the velocity measurement unit 185 (Step S66).

Subsequently, the controller 10 determines whether the surface velocity of the fixing belt 181 is the same as the surface velocity of the pressure roller 184 (Step S67).

If the surface velocity of the fixing belt 181 is not equal to the surface velocity of the pressure roller 184 (Step S67; NO), the controller 10 adjusts the surface velocity of the fixing belt 181 (Step S68). The process then returns to Step S66.

In Step S68, the control value of the first driver 186, which drives the fixing roller 182, is adjusted such that the surface velocity of the fixing belt 181 becomes closer to (substantially the same as) the surface velocity of the pressure roller 184. For instance, the adjusted control value of the first driver 186 may be calculated by the above-described (Expression 1).

If the surface velocity of the fixing belt 181 is equal to the surface velocity of the pressure roller 184 (Step S67; YES), the controller 10 determines the adjusted control value of the first driver 186 as the control value of the first driver 186 for the time of no-sheet passing and stores the control value in the storage 11 (Step S69). The process then proceeds to Step S70.

In Step S69, in, for instance, an apparatus that performs the fixing belt velocity control process B in response to the input of a job execution command, the adjusted control value of the first driver 186 is stored (overwriting) as the control value of the first driver 186 for the time of no-sheet passing in the predetermined area of the storage 11. In an apparatus that performs the fixing belt velocity control process C in response to the input of a job execution command, the adjusted control value of the first driver 186 is stored (addition) as the control value of the first driver 186 for the time of no-sheet passing in association with the surface velocity of the fixing belt 181 and the counter value at the time of the adjustment in the predetermined area of the storage 11.

In Step S70, the controller 10 determines the operations of Steps S61 to S69 have been completed for all the conditions.

When the operations of Steps S61 to S69 are determined not to have been completed for all the conditions (Step S70; NO), the process by the controller 10 returns to Step S61.

When the operations of Steps S61 to S69 are determined to have been completed for all the conditions (Step S70; YES), the controller 10 causes the fixing belt 181 and the pressure roller 184 to be separated from each other (Step S71) and terminates the adjustment mode process.

It should be noted that although the control value of the first driver 186 for the high-gloss mode is not adjusted in the above-described adjustment mode process, it is preferable that the control value of the first driver 186 for the high-gloss mode is also adjusted.

Verification Experiments of Fourth Embodiment

To verify the effects of the fourth embodiment, verification experiments (Experiments 19 and 20) were conducted.

In Experiment 19, 1000 (×1000) prints were made under the following conditions without performing the adjustment mode process. In Experiment 20, 1000 (×1000) prints were made under the following conditions by performing the above-described adjustment mode process every 100 (×1000).

Conditions

Pressure roller velocity (surface velocity): 800 mm/s

Target value of the fixing belt surface velocity: 800±5 mm/s

Fixing temperature: 180° C.

The other basic conditions are the same as those of the first embodiment.

It should be noted that since the surface velocity of the sheet the surface velocity of the pressure roller 184, the surface velocity of the sheet was defined as the pressure roller surface velocity.

Table IV shows experimental results.

TABLE IV

| Experiment No. | Adjustment mode | Image noise |
|---|---|---|
| 19 | No | Occurred |
| 20 | Performed every 100 (×1000) | Not occurred |

As shown in Table IV, Experiment 19, where 1000 (×1000) prints were made without performing the adjustment mode process, resulted in occurrence of image noise due to a small crack of the fixing belt caused when the fixing belt was in press-contact, whereas Experiment 20, where 1000 (×1000) prints were made by performing the above-described adjustment mode process every 100 (×1000), resulted in no occurrence of image noise.

Thus, it has been demonstrated that performing the adjustment mode process serves to reduce image noise even when a job is executed under conditions that have not been used for a long time.

Fifth Embodiment

A fifth embodiment of the present invention will be explained.

As described above, a high-gloss image can be obtained by making a velocity difference between the surface velocity of the fixing belt and the surface velocity of the sheet P (pressure roller 184), but continuous press-contact with the velocity difference causes the deterioration of the outer layer of the fixing belt 181, resulting in occurrence of image noise.

Accordingly, the fifth embodiment will be explained with reference to an instance where the fixing belt 181 is driven by the pressure roller 184 so that no velocity difference is made when no-sheet passes through the fixing nip during a job.

Since the configuration of the image forming apparatus 1 is the same as that explained in the first embodiment, the explanation thereof is incorporated by reference. It should be noted that the velocity measurement unit 185 is not necessary for this embodiment.

An operation according to the fifth embodiment will be explained below.

Figure 9:
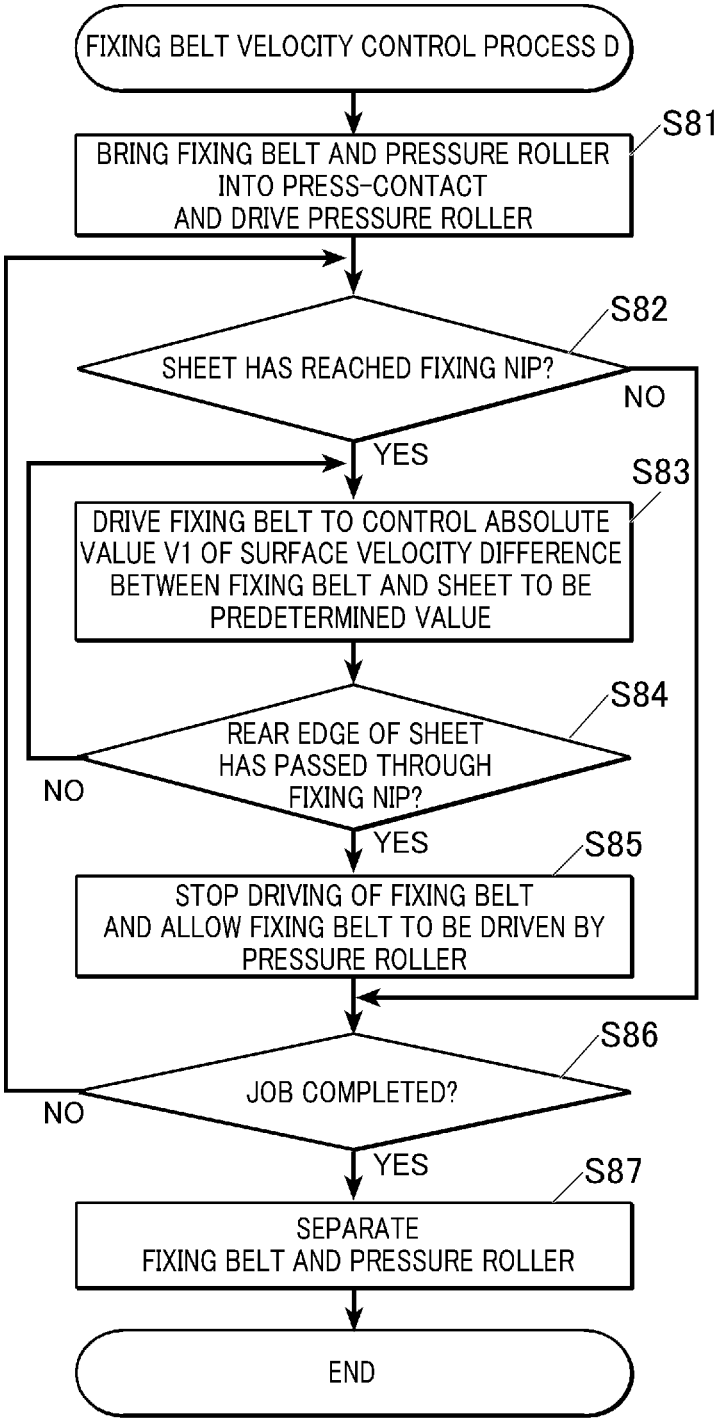
FIG. 9 is a flowchart showing a fixing belt velocity control process D being performed by the controller shown in FIG. 2.

FIG. 9 is a flowchart showing a fixing belt velocity control process D being performed by the controller 10. The fixing belt velocity control process D is performed in response to a job execution command in the high-gloss mode.

First, the controller 10 starts a job, causing the pressure roller 184 to come into press-contact with the fixing belt 181 while inputting the control value for the high-gloss mode to the second driver 187 for the rotation of the pressure roller 184 (Step S81). This causes the fixing roller 182 and the fixing belt 181 to be driven by the pressure roller 184.

The respective control values of the first driver 186 and the second driver 187 for the high-gloss mode are stored in advance in the ROM 103 or the storage for each of conditions such as paper type and basis weight.

Subsequently, the controller 10 determines whether a front edge of the sheet P has reached the fixing nip (Step S82). It may be determined whether the front edge of the sheet P has reached the fixing nip based on, for instance, a result of detection by a sensor such as an optical sensor (not shown) located upstream of the fixing nip in a sheet-conveyance direction.

If the sheet P has not reached the fixing nip (Step S82; NO), the process by the controller 10 proceeds to Step S86.

If the sheet P has reached the fixing nip (Step S82; YES), the controller 10 inputs the control value for the high-gloss mode to the first driver 186 to control an absolute value of the surface velocity difference between the fixing belt 181 and the sheet P to reach a predetermined value V1 (V1>0) (Step S83).

Subsequently, the controller 10 waits for a rear edge of the sheet P to pass through the fixing nip (Step S84). It may be determined whether the rear edge of the sheet P has passed through the fixing nip based on, for instance, a result of detection by a sensor such as an optical sensor (not shown) located downstream of the fixing nip in the sheet-conveyance direction.

If the rear edge of the sheet P has passed through the fixing nip (Step S84; YES), the controller 10 stops the driving of the first driver 186 and controls the fixing roller 182 and the fixing belt 181 to be driven by the pressure roller 184 (Step S85). The process then proceeds to Step S86.

In Step S86, the controller 10 determines whether the job has been completed (Step S86).

If the job has not been completed (Step S86; NO), the process by the controller 10 returns to Step S82.

If the job has been completed (Step S86; YES), the controller 10 causes the fixing belt 181 and the pressure roller 184 to be separated from each other (Step S87) and terminates the fixing belt velocity control process D.

Performing the above-described fixing belt velocity control process D allows the fixing belt 181 during the time of no-sheet passing, which is irrelevant to gloss control, to be driven by the pressure roller 184 with no surface velocity difference made between the pressure roller 184 and the fixing belt 181 during the time of no-sheet passing, thus reducing the deterioration of the fixing belt 181 and, consequently, reducing image noise.

Verification Experiments for Fifth Embodiment

To verify the effects of the fifth embodiment, verification experiments (Experiments 21 to 24) were conducted.

In each experiment, continuous printing was performed in the high-gloss mode with a pressure roller surface velocity of 600 mm/s and respective fixing belt surface velocities for the time of sheet passing and the time of no-sheet passing satisfying conditions shown in Table V, and the number of prints reached when noise occurred in the image was checked. Here, brake means that the fixing belt surface velocity is slower than the pressure roller surface velocity and assist means the fixing belt surface velocity is faster than the pressure roller surface velocity. In Table V, the respective fixing belt surface velocities of the time when sheet passes through the fixing nip and the time of no-sheet passing through the fixing nip are represented in velocity-based increment (%) or decrement (%) relative to the pressure roller surface velocity. It should be noted that the basic conditions other than the pressure roller surface velocity are the same as those of the verification experiments for the first embodiment (however, there is no job interval in the present experiments).

TABLE V

| Experiment No. | Sheet passing | No sheet passing | Noise occurrence point (×1000) |
|---|---|---|---|
| 21 | Brake 3% | Brake 3% | 600 |
| 22 | Brake 3% | OFF | 700 |
| 23 | Assist 3% | Assist 3% | 600 |
| 24 | Assist 3% | OFF | 700 |

As shown in Table V, it has been demonstrated that as compared with an instance where the an instance where brake or assist was applied during the time of sheet passing through the fixing nip and kept applied even during the time of no-sheet passing (Experiments 21 and 23), an instance where brake or assist was turned off during the time of no-sheet passing and the fixing belt 181 was driven by the pressure roller 184 (Experiments 22, 24) achieved a reduction in image noise (a delay in the time of occurrence of image noise).

Comparative Experiments in Terms of Fixing Belt Surface Hardness

Experiments for comparing durabilities of the fixing belt 181 resulting from different fixing belt surface hardnesses (HITs) were conducted with under the same conditions as those of Experiments 1 to 3 shown in Table I.

[Table VI] shows experimental results.

TABLE VI

| | Sheet passing Belt velocity | No sheet passing Belt velocity | Absolute value of velocity difference from pressure roller | Noise occurrence point (×1000) | HIT | Experiment No. |
|---|---|---|---|---|---|---|
| High-gloss mode | 515 | 515 | 15 | 450 | 3 | 25 |
| | | 495 | 5 | 550 | 3 | 26 |
| | | 505 | 5 | 650 | 3 | 27 |
| High-gloss mode | 515 | 515 | 15 | 500 | 3.5 | 1 |
| | | 495 | 5 | 600 | 3.5 | 2 |
| | | 505 | 5 | 700 | 3.5 | 3 |
| High-gloss mode | 515 | 515 | 15 | 700 | 4 | 28 |
| | | 495 | 5 | 710 | 4 | 29 |
| | | 505 | 5 | 720 | 4 | 30 |

As shown in Table VI, when the fixing belt 181 has a soft outer layer with an indentation hardness HIT of 3.5 N/mm$^2$ or less measured by nanoindentation, an effect of reducing the absolute value difference between the fixing belt surface velocity and the surface velocity of the pressure roller 184 during the time of no-sheet passing to be smaller than during the time of sheet passing is outstanding Even when the fixing belt 181 has a hard outer layer, an effect of the control according to the present invention in noise reduction is still achievable but weak due to the hardness of the belt outer layer.

Although the first to fifth embodiments of the present invention are explained above, the above embodiments are merely preferred examples of the present invention and by no means limit the present invention.

For instance, in the above embodiments, the image forming apparatus 1 is a color-image forming apparatus capable of subsequently transferring toner images, which are formed on photosensitive bodies, onto a transfer body but may be a tandem color-image forming apparatus capable of arranging a plurality of image carriers with individual colors on an intermediate transfer body in series or, alternatively, a black-and-white-image forming apparatus capable of forming an image with a single-color toner.

In addition, the detailed configurations and detailed operations of the image forming apparatus may also be modified as needed without departing from the spirit of the present invention.

Although embodiments of the present invention have been described and illustrated in detail, the disclosed embodiments are made for purposes of illustration and example only and not limitation. The scope of the present invention should be interpreted by terms of the appended claims The specification, claim(s), drawing(s), and abstract of Japanese Patent Application No. 2018-150972, filed with the Japan Patent Office on Aug. 10, 2018, are incorporated herein by reference in its entirety.

What is claimed is:

1. An image forming apparatus comprising:

a fixer that includes a fixing rotation body and a pressing rotation body between which a fixing nip is formed, and that heats and presses a fed sheet through the fixing nip so that a toner image formed on the sheet is fixed to the sheet; and a hardware processor that makes a velocity difference between a surface velocity of the fixing rotation body and a surface velocity of the sheet passing through the fixing nip during an operation in a high-gloss mode so as to adjust a gloss of the toner image formed on the sheet, wherein the hardware processor performs a control so that an absolute value of a velocity difference between the surface velocity of the fixing rotation body and a surface velocity of the pressing rotation body at a time when the sheet does not pass through the fixing nip with the fixing rotation body and the pressing rotation body being in press-contact with each other is less than an absolute value of the velocity difference between the surface velocity of the fixing rotation body and the surface velocity of the sheet at a time when the sheet passes through the fixing nip during the operation in the high-gloss mode.

2. The image forming apparatus according to claim 1, further comprising a measurement unit that measures the surface velocity of the fixing rotation body, wherein the hardware processor controls the velocity difference between the surface velocity of the fixing rotation body and the surface velocity of the pressing rotation body at the time when the sheet does not pass through the fixing nip by adjusting the surface velocity of the fixing rotation body based on a measurement result from the measurement unit.

3. The image forming apparatus according to claim 1 wherein the hardware processor performs an adjustment so that the surface velocity of the fixing rotation body at the time when the sheet does not pass through the fixing nip is substantially equal to the surface velocity of the pressing rotation body.

4. The image forming apparatus according to claim 2, wherein the hardware processor adjusts the surface velocity of the fixing rotation body so that a magnitude relationship between the surface velocity of the fixing rotation body and the surface velocity of the pressing rotation body at the time when the sheet does not pass through the fixing nip becomes the same as a magnitude relationship between the surface velocity of the fixing rotation body and the surface velocity of the sheet at the time when the sheet passes through the fixing nip.

5. The image forming apparatus according to claim 2, wherein the hardware processor adjusts the surface velocity of the fixing rotation body by adjusting a control value that is to be input to a driver that drives the fixing rotation body.

6. The image forming apparatus according to claim 5, further comprising a storage that stores another control value of the driver previously adjusted by the hardware processor at a time when the sheet did not pass through the fixing nip, wherein the hardware processor determines the other control value stored in the storage as the control value that is to be input to the driver at the time when the sheet does not pass through the fixing nip.

7. The image forming apparatus according to claim 5, further comprising a storage that stores a plurality of other control values of the driver previously adjusted by the hardware processor at a time when the sheet did not pass through the fixing nip in association with resulting surface velocities of the fixing rotation body obtained by inputting the other control values to the driver, wherein the hardware processor predicts, based on a relationship between the other previous control values of the driver and the resulting surface velocities of the fixing rotation body stored in the storage, another control value of the driver that makes the surface velocity of the fixing rotation body substantially the same as the surface velocity of the pressing rotation body, and determines the predicted control value as the control value that is to be input to the driver at the time when the sheet does not pass through the fixing nip.

8. The image forming apparatus according to claim 6, wherein the hardware processor adjusts, in response to detecting a predetermined state, the control value of the driver so that the surface velocity of the fixing rotation body becomes substantially equal to the surface velocity of the pressing rotation body at the time when the sheet does not pass through the fixing nip, and stores in the storage the adjusted control value and/or a resulting surface velocity of the fixing rotation body obtained by inputting the adjusted control value to the driver.

9. The image forming apparatus according to claim 1, wherein an outer layer of the fixing rotation body has an indentation hardness HIT of 3.5 $N/mm^2$ or less measured by nanoindentation.

10. An image forming apparatus comprising:

a fixer that includes a fixing rotation body and a pressing rotation body between which a fixing nip is formed, and heats and presses a fed sheet through the fixing nip so that a toner image formed on the sheet is fixed to the sheet; and a hardware processor that makes a velocity difference between a surface velocity of the fixing rotation body and a surface velocity of the sheet passing through the fixing nip during an operation in a high-gloss mode to adjust a gloss of the toner image formed on the sheet, wherein the hardware processor does not drive the fixing rotation body but forces the fixing rotation body to be driven by the rotating pressing rotation body, when the sheet does not pass through the fixing nip with the fixing rotation body and the pressing rotation body being in press-contact with each other.

11. The image forming apparatus according to claim 10, wherein an outer layer of the fixing rotation body has an indentation hardness HIT of 3.5 $N/mm^2$ or less measured by nanoindentation.

* * * * *